US005676590A

United States Patent [19]

Hiraoka

[11] Patent Number: 5,676,590

[45] Date of Patent: Oct. 14, 1997

[54] POLISHING APPARATUS PROVIDED WITH ABRASIVE CLOTH

[75] Inventor: Naoki Hiraoka, Kasugai, Japan

[73] Assignee: Fujitsu Limited, Kawasaki, Japan

[21] Appl. No.: 580,924

[22] Filed: Dec. 29, 1995

[30] Foreign Application Priority Data

Mar. 16, 1995 [JP] Japan ..... 7-057661

[51] Int. Cl.[6] ..... B24B 5/00

[52] U.S. Cl. ..... 451/287; 414/797; 451/289; 451/5

[58] Field of Search ..... 414/797, 787; 451/285, 287, 289, 5

[56] References Cited

U.S. PATENT DOCUMENTS

| | | | |
|---|---|---|---|
| 3,552,584 | 1/1971 | Heinrich | 414/797 |
| 4,392,766 | 7/1983 | Blunt | 414/797 |
| 4,407,627 | 10/1983 | Sato et al. | 414/787 |
| 4,487,409 | 12/1984 | Orii | 414/797 |
| 4,527,358 | 7/1985 | Day | 451/287 |
| 4,553,892 | 11/1985 | Huffman et al. | 414/797 |
| 4,960,361 | 10/1990 | Melzer | 414/786 |
| 5,482,496 | 1/1996 | Lanzer | 451/5 |

*Primary Examiner*—Timothy V. Eley
*Assistant Examiner*—Dona C. Edwards
*Attorney, Agent, or Firm*—Armstrong, Westerman, Hattori, McLeland & Naughton

[57] ABSTRACT

A polishing apparatus includes a table on which an abrasive cloth is removably applied and an abrasive cloth replacing unit for automatically replacing the abrasive cloth locating on the table with a new abrasive cloth. The replacing unit includes a cloth storage device for storing a plurality of unused abrasive cloths, an abrasive cloth carrier and an abrasive cloth applier. The cloth carrier picks up an abrasive cloth located on the table and carries it to a disposal site and then picks up a new abrasive cloth from the cloth storage device and carries it to the table. The cloth applier presses an abrasive cloth against the table.

19 Claims, 9 Drawing Sheets

POLISHING APPARATUS PROVIDED WITH ABRASIVE CLOTH

BACKGROUND OF THE INVENTION

1. Field of the Invention

The present invention generally relates to a polishing apparatus in which a material to be polished is abutted against an abrasive cloth applied on the top surface of a rotary table. More particularly, the present invention relates to an apparatus for facilitating replacement of the abrasive cloth applied on the top surface of the rotary table.

2. Description of the Related Art

Improvements in semiconductor device processing has led to higher integration and super-refining processing techniques. As a result of these higher integration and super-refining of semiconductor devices, wiring is now required to be much finer and much more multi-layered than before. In compliance with such request, the resolution of exposure apparatuses has increased to have shorter foci. With the development of short focus exposure apparatuses, semiconductor wafers are further required to have improved surface flatness.

FIG. 1 shows a typical apparatus used for chemical and mechanical polishing (CMP) for planarizing wafer surfaces. A surface plate 180 forming a rotary table is fixed to a rotary shaft 181. An abrasive cloth 182 is applied on the top surface of the surface plate 180. A head 183 is fixed to another rotary shaft 184. A pad 185 is applied to the lower surface of the head 183. The lower surface of the pad 185 is wetted with purified water, and the pad 185 is pressed against a wafer 186 to immobilize it on the pad 185 using the surface tension of the water.

Planarization polishing of the wafer 186 is carried out by rotating the wafer 186 immobilized on the pad 185 together with the head 183 to press the rotating wafer 186 against the abrasive cloth 182 rotating together with the surface plate 180. During this polishing treatment, an abrasive liquid L1 and a rinse L2 are dropped onto the abrasive cloth 182 through a first supply pipe 187 and a second supply pipe 188, respectively. The abrasive liquid L1 contains abrasive grains and a solution for etching a film formed on the wafer surface. Purified water is generally employed as the rinse L2.

The film on the wafer surface is gradually etched by the abrasive liquid L1. A reaction product is formed on the wafer surface during this etching treatment. The reaction product is rubbed and ground by the abrasive cloth 182 and the abrasive grains collected on the surface of the cloth 182, and thus the wafer surface is planarized.

The abrasive cloth 182 is generally made of a polyurethane foam. The polyurethane foam has fine roughness on the surface to be easily impregnated with the abrasive liquid L1. However, the surface roughness of the abrasive cloth 182 is decreased due to wearing of the surface of the polyurethane foam and to clogging by the debris of the ground reaction product with repeated runs of polishing treatment. This leads to reduction in the polishing rate. For example, when a 5-minute polishing cycle is repeated 10 times, the polishing rate drops by about 50%.

In order to achieve longevity of the abrasive cloth, there is generally employed a dresser which restores surface roughness of the abrasive cloth. Others attempt to achieve longevity of the abrasive cloth 182 by changing the material of the abrasive cloth 182 so as to control reduction in the polishing rate.

However, even if longevity of the abrasive cloth is successfully achieved, it is of a consumable material, so that the abrasive cloth must be replaced periodically. A double-coated adhesive seal is applied on the rear surface of the abrasive cloth 182. The abrasive cloth 182 is adhered to the surface plate 180 via the adhesive seal.

Replacement of the abrasive cloth is carried out manually by an operator. After the used abrasive cloth 182 is peeled from the surface plate 180, a new abrasive cloth 182 is applied to the surface plate 180. Since the abrasive cloth 182 is pressed many times by the head 183 during polishing treatments, it is strongly adhered to the surface plate 180. Accordingly, tremendous labor is needed for the operator in peeling off the abrasive cloth 182.

The new abrasive cloth 182 is applied to the surface plate 180 while a backing paper covering the adhesive seal is peeled off. In this process, the operator must be careful not to include air cells between the adhesive seal and the surface plate 180. Inclusion of air cells prevents the abrasive cloth 182 from having an even surface and often damages the wafer 186 during polishing. Accordingly, the procedures of applying the abrasive cloth 182 require the skill of an expert.

The abrasive liquid employed in the polishing treatment contains a large amount of abrasive grains having a diameter of about 0.3 micron, besides an alkali metal as a component. These materials lead to heavy pollution around the surface plate 180. Such pollution in the polishing apparatus affects other processing steps. Accordingly, the polishing apparatus is installed in a closed housing or a clean room provided with an air exhausting system. However, since replacement of the abrasive cloth is carried out manually by an operator, the abrasive grains and alkali metals are diffused onto the clothing of the operator and then carried outside to cause pollution in other processing steps.

SUMMARY OF THE INVENTION

Broadly speaking, the present invention relates to a polishing apparatus in which an abrasive cloth can be replaced automatically requiring no manual procedures of operators as well as to an abrasive cloth product that allows efficient replacement procedures.

A polishing apparatus according to an embodiment of the invention includes a table, on which an abrasive cloth is removably applied, and an abrasive cloth replacing unit for automatically replacing the abrasive cloth located on the table with a new abrasive cloth.

The abrasive cloth replacing unit preferably includes a cloth storage device for storing a plurality of unused abrasive cloths, and an abrasive cloth carrier. The abrasive cloth carrier picks up an abrasive cloth located on the table and carries the abrasive cloth to a disposal site and then picks up a new abrasive cloth from the cloth storage device and carries the new abrasive cloth to the table. It is preferable that the abrasive cloth replacing unit further include an abrasive cloth applier for pressing an abrasive cloth against the table.

Other aspects and advantages of the invention will become apparent from the following detailed description, taken in conjunction with the accompanying drawings, illustrating by way of example the principals of the invention.

BRIEF DESCRIPTION OF THE DRAWINGS

The invention, together with the objects and advantages thereof, may best be understood by reference to the following description of the presently preferred embodiments taken in conjunction with the accompanying drawings in which.

DETAILED DESCRIPTION OF THE PREFERRED EMBODIMENTS

Figure 1:
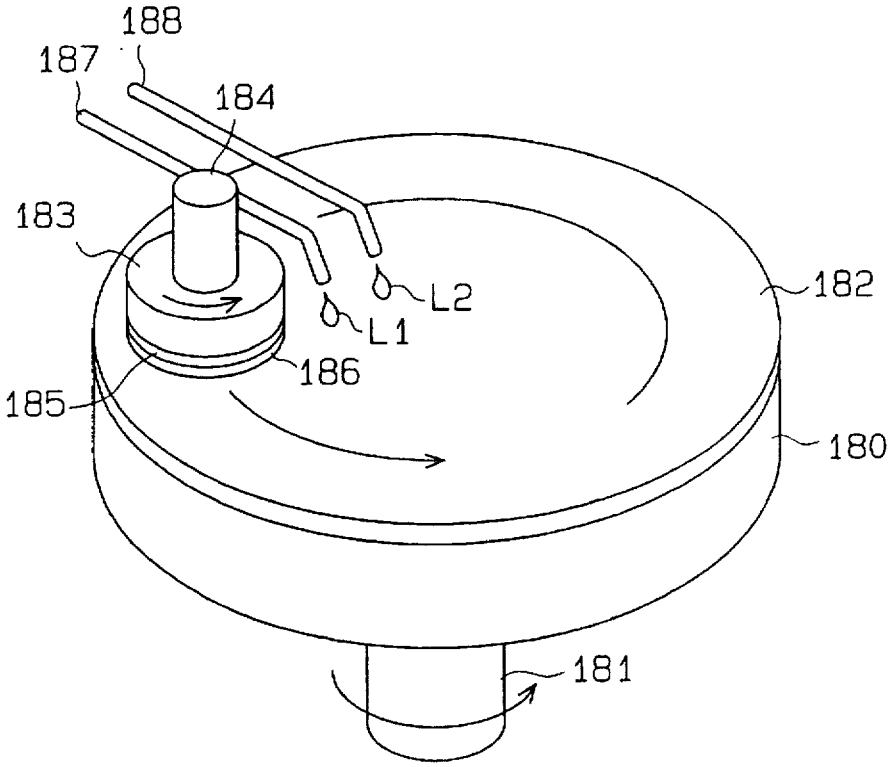
Fig.1 (Prior Art)
FIG. 1 is a perspective view of a conventional chemical and mechanical polishing apparatus.
Figure 2:
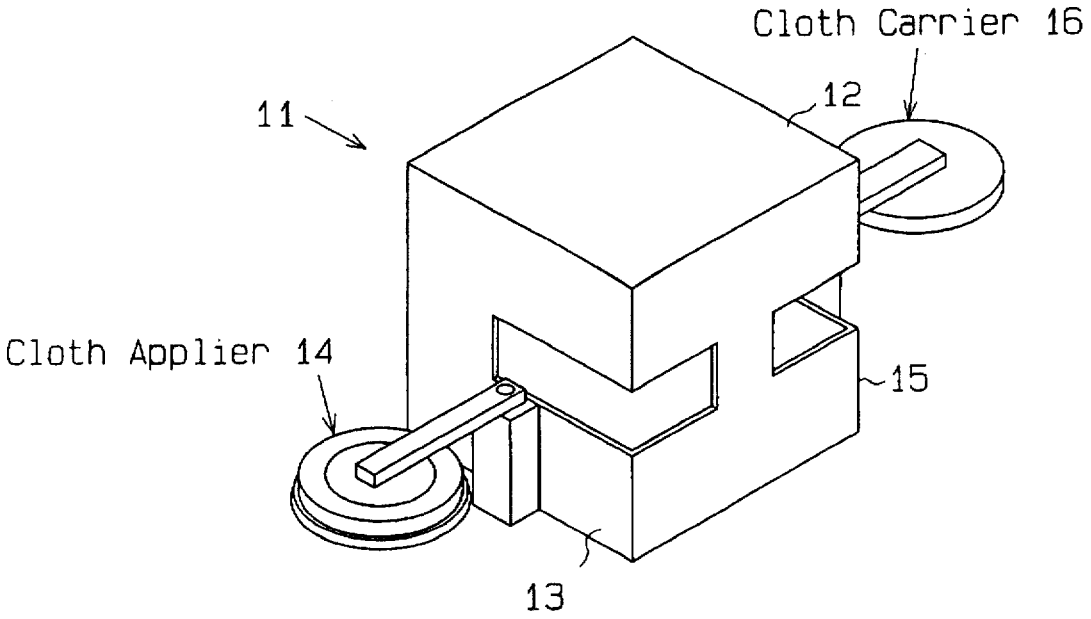
FIG. 2 is a perspective view of a polishing apparatus according to an embodiment of the present invention.

An embodiment of the present invention will be now described referring to FIGS. 2 to 13, FIG. 2 shows an overall view of a polishing apparatus 11. The polishing apparatus 11 is covered with a rectangular casing 12. An abrasive cloth applier 14 is disposed on the left side wall 13 of the casing 12, and an abrasive cloth carrier 16 is disposed on the right side wall 15 of the casing 12. The abrasive cloth applier 14 and the abrasive cloth carrier 16 are constituents of an abrasive cloth replacing unit.

Figure 3:
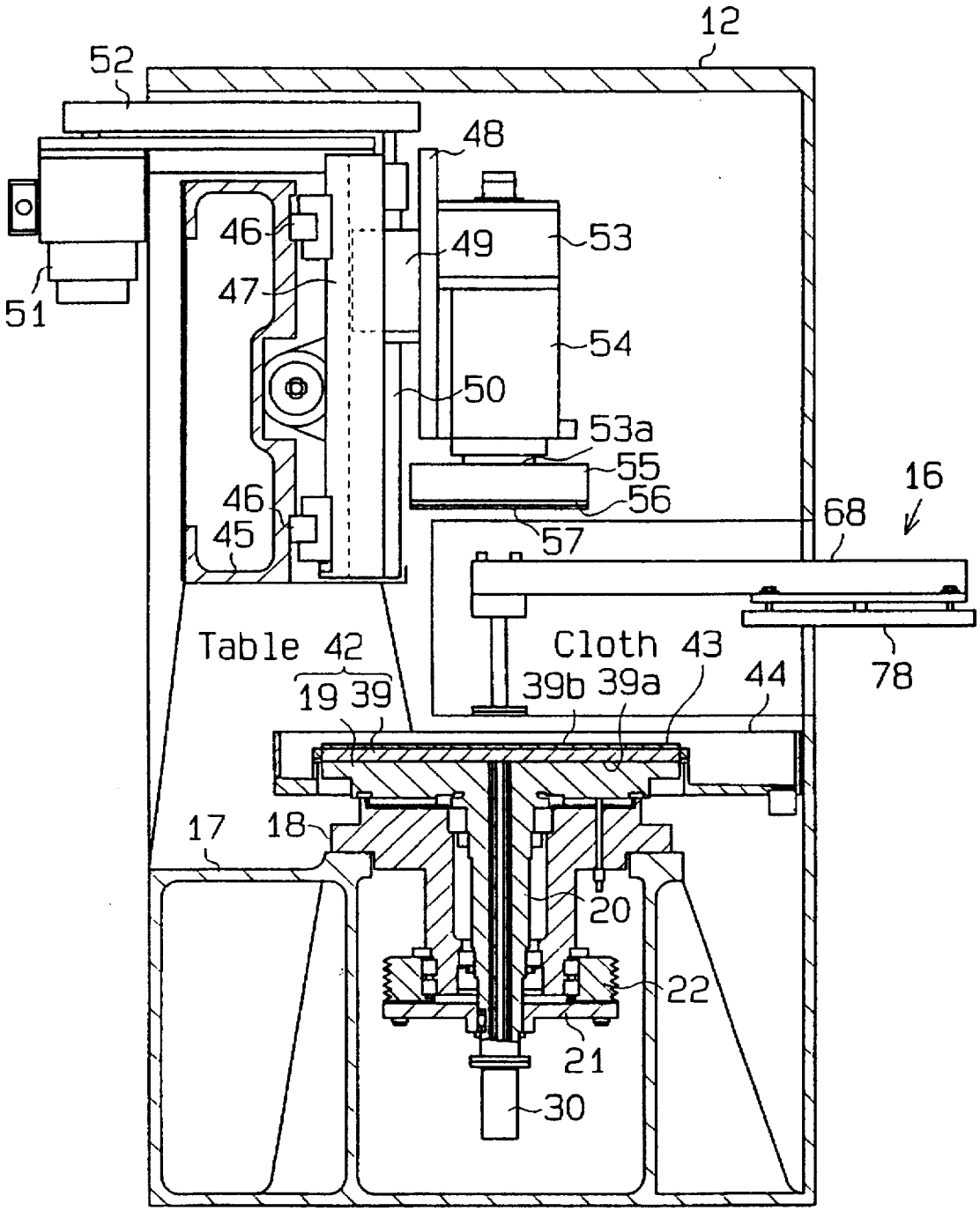
FIG. 3 is a vertical cross-sectional view of the polishing apparatus.
Figure 4:
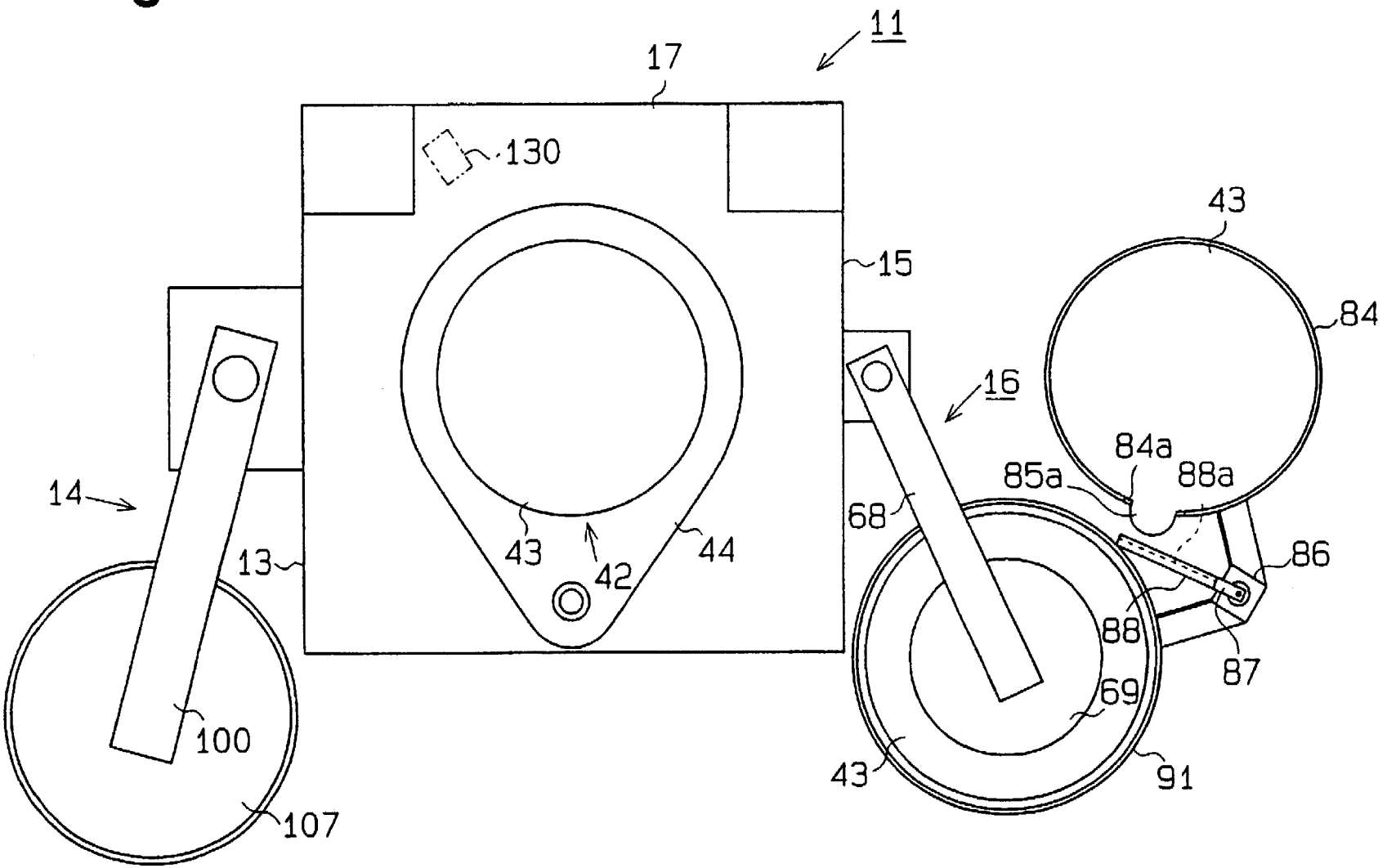
FIG. 4 is a horizontal cross-sectional view of the polishing apparatus.

As shown in FIGS. 3 and 4, the casing 12 contains a bed 17 on which a bearing 18 is secured. The bearing 18 supports a rotary shaft 20 of a surface plate 19. A flange 21 is fixed to the lower end portion of the rotary shaft 20 protruding from the bearing 18. A pulley 22 is provided on the upper surface of the flange 21. The pulley 22 is connected to a motor (not shown) via a belt (not shown). Accordingly, the surface plate 19 is rotated via the pulley 22, flange 21 and rotary shaft 20 under driving by the motor.

Figure 5:
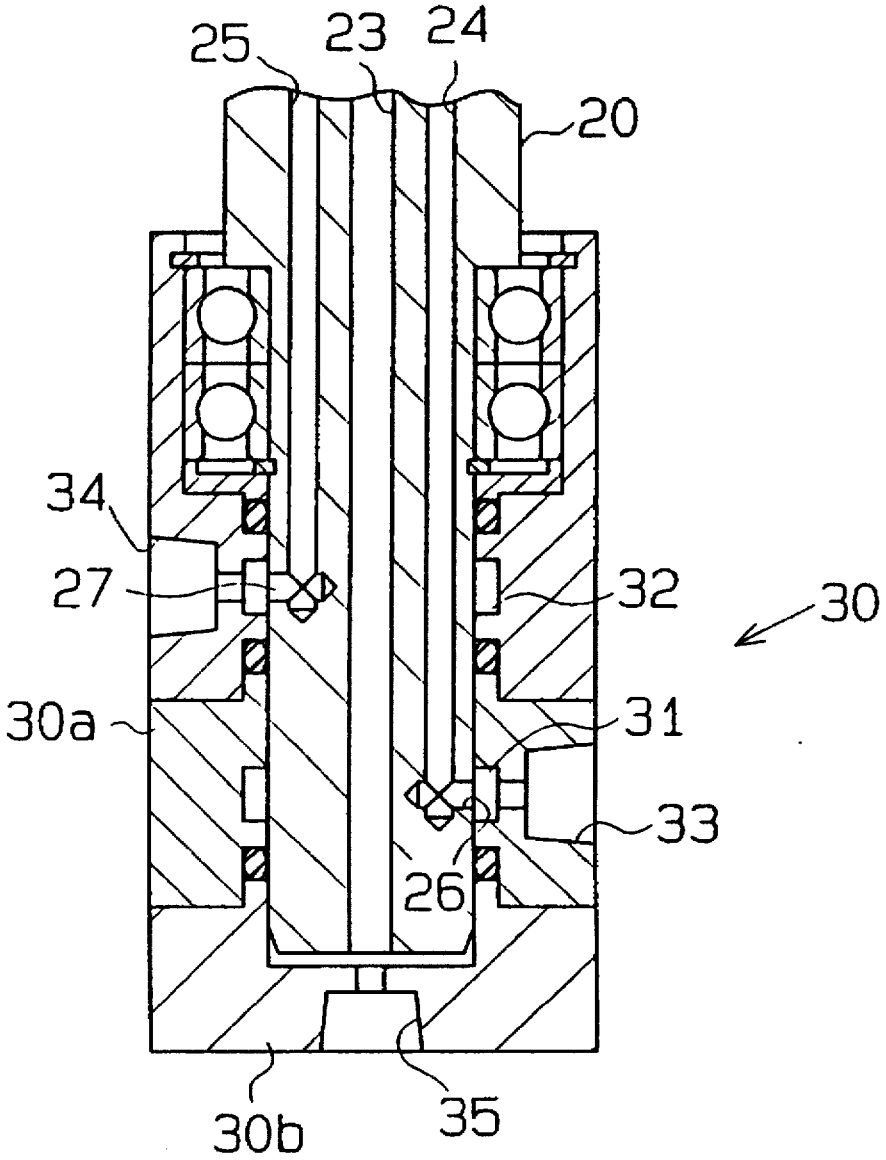
FIG. 5 is a vertical cross-sectional view of a rotary seal.

As shown in FIG. 5, the rotary shaft 20 has three passages 23 to 25 formed therein. A first passage 23 is defined at the axial center of the shaft 20 to connect the lower end face of the shaft 20 to the surface plate 19. A second passage 24 is defined adjacent to the first passage 23 to connect the surface plate 19 to a suction port 26 formed at a lower end portion of the circumferential wall of the shaft 20. A third passage 25 is also defined adjacent to the first passage 23 to connect the surface plate 19 to a discharge port 27 formed at a lower end portion of the circumferential wall of the shaft 20.

FIG. 5 shows a rotary seal 30 which is supported by a supporting member (not shown) provided on the bed 17. The rotary seal 30 rotatably supports the rotary shaft 20. The rotary seal 30 includes a water supply and discharge block 30*a* and an air supply and exhaust block 30*b*. The water supply and discharge block 30*a* has an annular groove 31 formed at a lower portion on the inner circumference thereof and another annular groove 32 formed at an upper portion on the inner circumference thereof. The groove 31 is opposed to the suction port 26 of the rotary shaft 20, whereas the groove 32 is opposed to the discharge port 27 of the rotary shaft 20. The water supply and discharge block 30*a* also has a supply port 33 and a discharge port 34 formed on the outer circumferential wall. The supply port 33 connects the groove 31 to a pump (not shown). The discharge port 34 connects the groove 32 to a drain tank (not shown). The air supply and exhaust block 30*b* has a suction port 35 which connects the first passage 23 to a suction pump (not shown).

Figure 6:
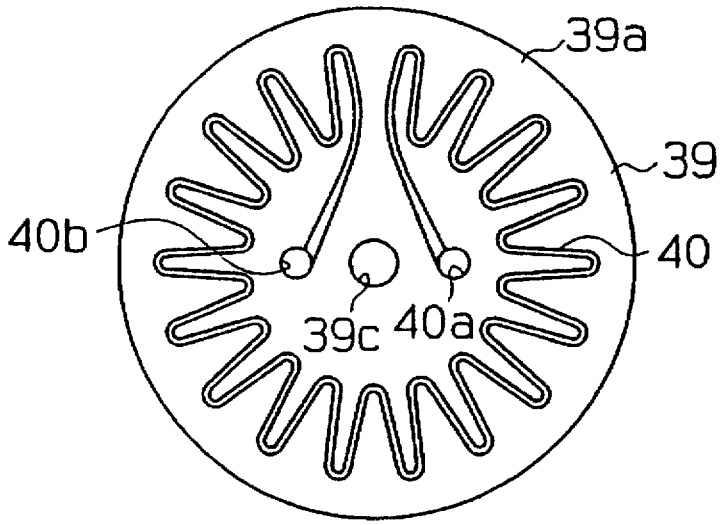
FIG. 6 is a bottom plan view of an adhesion disc.

As shown in FIG. 3, an adhesion disc 39 is secured on the upper surface of the surface plate 19. As shown in FIG. 6, a water introduction passage 40 is defined on the rear surface 39*a* of the adhesion disc 39. The introduction passage 40 has a starting point 40*a* opposed to the second passage 24 and an end point 40*b* opposed to the third passage 35. The introduction passage 40 is distributed uniformly over the rear surface 39*a* of the adhesion disc 39. More specifically, when hot water or cold water is supplied to the starting point 40*a* of the introduction passage 40 with the adhesion disc 39 being fixed to the surface plate 19, the water flows through the introduction passage 40 to be discharged from the end point 40*b* to the third passage 25. Accordingly, the adhesion disc 39 can be heated uniformly by the hot water or cooled uniformly by the cold water.

Figure 7:
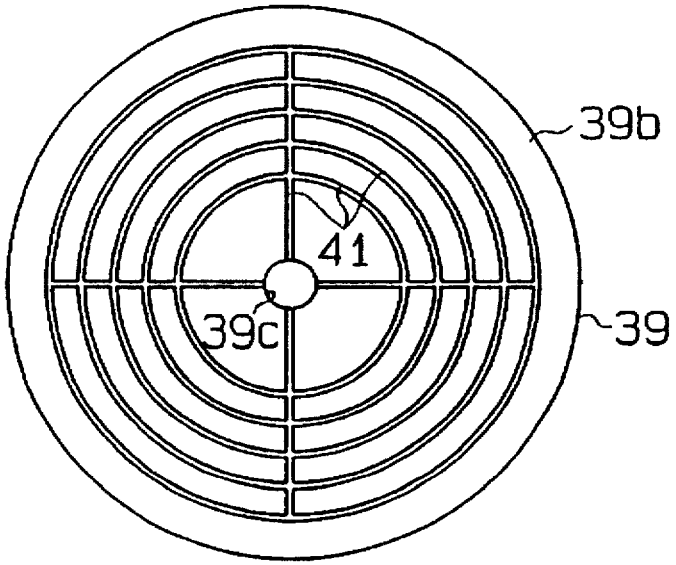
FIG. 7 is a top plan view of the adhesion disc.

As shown in FIG. 7, grooves 41 are defined on the upper surface 39*b* of the adhesion disc 39. The grooves 41 consist of a plurality of concentric annular grooves and radial grooves connecting the annular grooves to one another. A through hole 39*c* is defined at the center of the adhesion disc 39 where the radial grooves intersect with each other to be in alignment with the first passage 23. In this embodiment, the surface plate 19 and the adhesion disc 39 forms a rotary table 42.

An abrasive cloth 43, made of a polyurethane foam, is adhered by an adhesive onto the upper surface 39*b* of the adhesion disc 39. Accordingly, the abrasive cloth 43 can be rotated together with the rotary table 42. Incidentally, the diameter of the abrasive cloth 43 is preferably slightly smaller than that of the adhesion disc 39 in this embodiment. The abrasive cloth used is preferably IC 1000 (trade name, manufactured by Rodel Nitta Corp.) or Suba 400 (trade name, manufactured by Rodel Nitta Corp.).

As shown in FIG. 3, a sink 44 is located around the rotary table 42. An abrasive liquid and a rinse to be dropped onto the abrasive cloth 43 through supply pipes (not shown), respectively, during polishing treatment. The abrasive liquid and the rinse are adapted to flow from the abrasive cloth 43 into the sink 44. The abrasive liquid and rinse thereafter are discharged to the outside through the sink 44. In this embodiment, CAB-O-SPERSE SC-112 (trade name, manufacture by CABOT) may be employed as the abrasive liquid.

A frame 45 is secured in the casing 12. A pair of upper and lower rails 46 are horizontally fixed on the front surface of the frame 45. A first base 47 is movably supported by the frame 45 via the rails 46. The first base 47 is designed to be reciprocated horizontally by a known driving mechanism (not shown).

A second base 48 is supported on the front surface of the first base 47 to be movable in the vertical direction. A female screw 49 is fixed to the rear surface of the second base 48, and a male screw rod 50 rotatably supported on the first base 47 is screwed into the female screw 49. The male screw rod 50 is connected to a motor 51 via a belt 52 to be rotated clockwise or counter-clockwise in accordance with the rotation of the motor 51. With the rotation of the male screw rod 50, the second base 48 is reciprocated vertically with respect to the first base 47.

A motor 53 and a bearing shell 54 are fixed to the second base 48, and the rotary shaft 53*a* of the motor 53 is rotatably supported in the bearing shell 54. A head 55 is fixed to the lower end of the rotary shaft 53*a* to be rotated with the rotation of the motor 53. A polyurethane foam pad 56 is fixed on the surface of the head 55. A semiconductor wafer 57, as the material to be polished, is affixed to the lower surface of the pad 56. The surface to be polished in the semiconductor wafer 57 is a thermal oxide layer, a BPSG layer and TEOS layer (films formed by CVD method).

Accordingly, the wafer 57 affixed to the head 55 is abutted against the abrasive cloth 43 applied onto the rotary table 42 by descending the second base 48. When the motor 53 is driven, the wafer 57 is rotated as abutted against the abrasive cloth 43. The wafer 57 is reciprocated in the radial direction of the rotary table 42 as abutted against the abrasive cloth 43 by moving the first base 47 in the horizontal direction.

Figure 8:
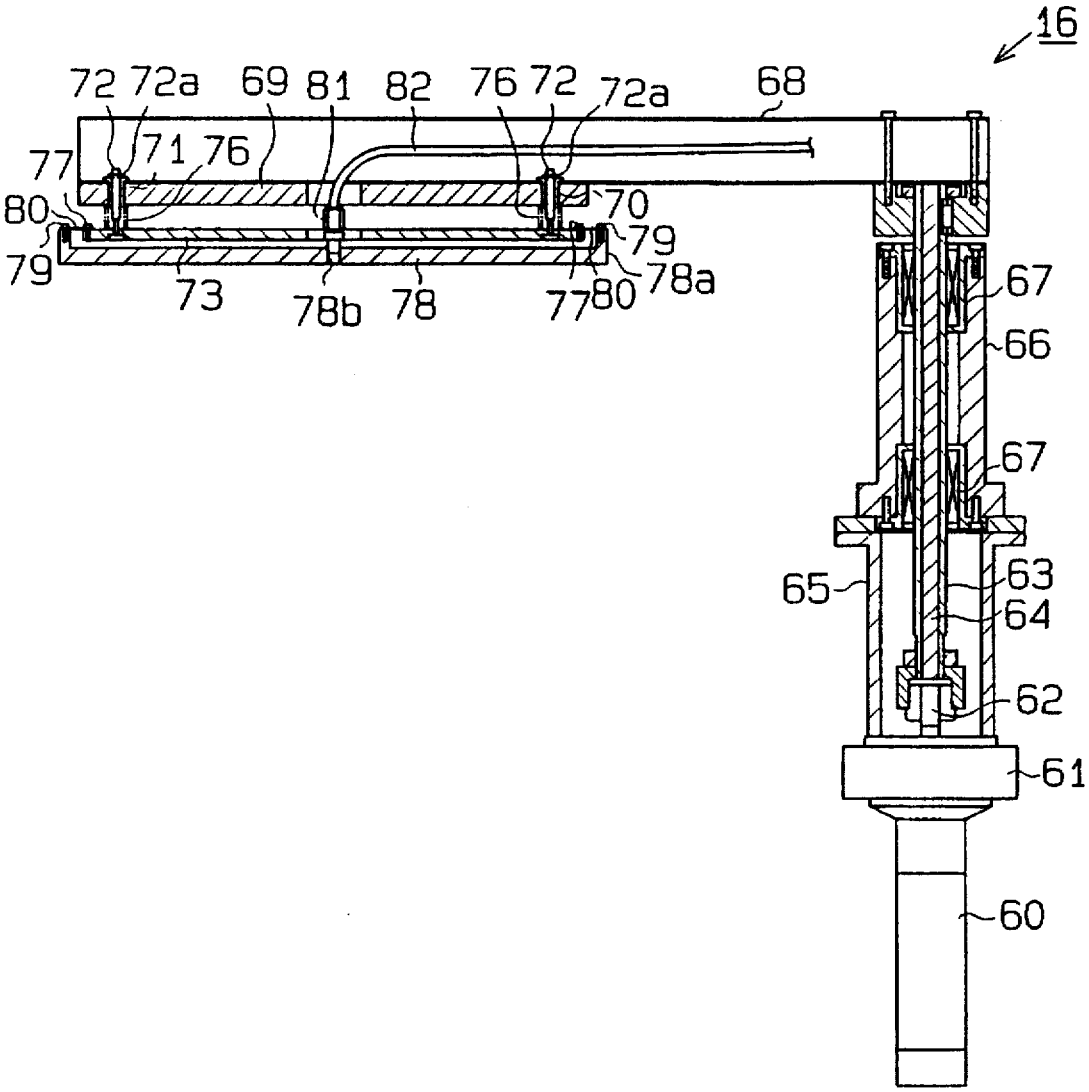
FIG. 8 is a vertical cross-sectional view of an abrasive cloth carrier.

The abrasive cloth carrier 16 is disposed on the right side wall 15 of the casing 12. As shown in FIG. 8, the abrasive cloth carrier 16 has a drive cylinder 60 fixed to the right side wall 15 and a rotary cylinder 61 disposed above the drive cylinder 60. The rotary cylinder 61 also serves as another drive cylinder. The rod 62 of the cylinder 60 is reciprocated by the cylinder 60 in the vertical direction and is rotated by the rotary cylinder 61. The rod 62 is connected to a pipe 63 and a rotary shaft 64 inserted to the pipe 63. The junction of the rod 62 with the pipe 63 and rotary shaft 64 is housed in a covering barrel 65 fixed to the rotary cylinder 61. The pipe 63 and rotary shaft 64 are supported by a pair of bearings 67 attached to a housing 66 fixed to the covering barrel 65 to be movable in the vertical direction and to be rotatable.

Figure 9:
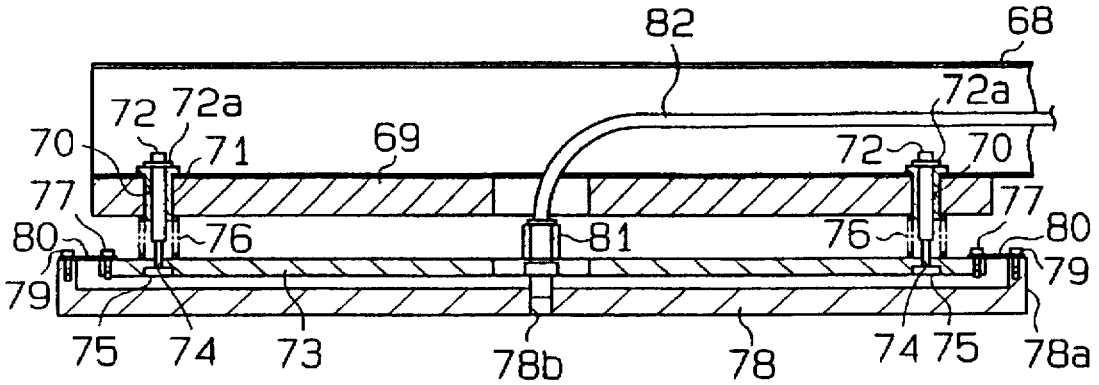
FIG. 9 is an enlarged cross-sectional view around a suction plate in the abrasive cloth carrier.

A tubular arm 68 having a rectangular cross section is fixed to the upper ends of the pipe 63 and of the rotary shaft 64. The arm 68 is ascended or descended vertically by the pipe 63 and rotary shaft 64 and is also pivoted on the proximal end portion on the horizontal plane. A circular supporting plate 69 is fixed on the lower surface of the arm 68. As shown in FIG. 9, the supporting plate 69 has a plurality of through holes 70 defined at equiangular intervals. A flanged pipe 71 is inserted from the inside of the arm 68 into each through hole 70. A guide pin 72 is inserted to each pipe 71. A stopper 72*a* provided on the upper end of the guide pin 72 prevents the guide pin 72 from slipping off the pipe 71.

A circular connecting plate 73 has fitting holes 74 defined to be aligned with the through holes 70 of the supporting plate 69, respectively. A bolt 75 is inserted upward to each fitting hole 74 and screwed into the guide pin 72 protruding from the pipe 71. Accordingly, the connecting plate 73 is suspended from the supporting plate 69 to be movable in the vertical direction via the bolts 75 and guide pins 72. Springs 76 are provided around the guide pins 72 and sandwiched between the connecting plate 73 and the supporting plate 69. Each spring 76 has a resilience to push the connecting plate 73 downward.

A plurality of bolts 77 are attached along the periphery of the connecting plate 73 at equiangular intervals. A circular suction plate 78 is located below the connecting plate 73. The suction plate 78 has a rib 78*a* formed along the periphery, and a plurality of bolts 79 are screwed into the rib 78*a* to be in alignment with the bolts 77 of the connecting plate 73, respectively. A leaf spring 80 is interposed between each opposing pair of bolts 77 and 79 to support the suction plate 78 on the connecting plate 73.

The suction plate 78 has a suction port 78*b* formed at the center thereof. A joint 81 is connected to the suction port 78*b* of the suction plate 78, and the joint 81 is connected to a suction pump (not shown) via a suction pipe 82. Grooves (not shown) are defined on the lower surface of the suction plate 78. These grooves are of the same profile as the grooves 41 shown in FIG. 7 and contain a plurality of concentric annular grooves and radial grooves connecting the annular grooves to one another. The suction port 78*b* is located at the intersection of the radial grooves.

The arm 68 reciprocates between the rotary table 42 and a cylindrical stocker 84 (cloth storage device) disposed outside the casing 12, as shown in FIG. 4. Specifically, the arm 68 is pivoted clockwise or counterclockwise between a position where the suction plate 78 is aligned with the rotary table 42 and a position where the suction plate 78 is aligned with the stocker 84. Incidentally, the suction plate 78 has an outer diameter smaller than that of the abrasive cloth 43.

The stocker 84 contains a stack of unused abrasive cloths 43. Each abrasive cloth 43 is coated with an adhesive on the rear surface with a backing paper 85 being removably applied to the adhesive layer formed on the rear surface of the cloth 43. The backing paper 85 and the abrasive cloth 43 are of the same shape. The backing paper 85 prevents the abrasive cloths from sticking to one another.

The adhesive employable according to this embodiment is of a type which loses adhesiveness at a high temperature, and includes, for example, LIBACLEAN (trade name, manufactured by Nitto Denko Kabushiki-Kaisha) and LIBAALFA No. 3195 (trade name, manufactured by Nitto Denko Kabushiki-Kaisha). When adhesiveness of LIBACLEAN or LIBAALFA No. 3195 is to be deactivated, an ambient temperature of 80° C. or higher, more desirably 85° C. or higher, most desirably 90° C. or higher should be employed.

Accordingly, with the abrasive cloth 43 applied onto the rotary table 42, when hot water is supplied to the introduction passage 40 of the adhesion disc 39, the adhesive is deactivated so that the abrasive cloth 43 can be easily peeled from the adhesion disc 39.

As shown in FIG. 4, the backing paper 85 has a semicircular tongue 85*a* extended from the periphery. The stocker 84 is partially notched on the side wall from the top to the bottom to define a window 84*a*. When unused abrasive cloths 43 are placed in the stocker 84, the tongues 85*a* protrude out of the window 84*a*.

The unused abrasive cloths 84 contained in the stocker 84 are sucked one by one, by the suction plate 78. Specifically, when air is sucked through the suction pipe 82 connected to the suction plate 78 in the state where the suction plate 78 is aligned over the surface of an uppermost abrasive cloth 43, the cavities of the grooves defined on the suction plate 78 assume negative pressure, and thus the abrasive cloth 43 is sucked up onto the suction plate 78.

The thus sucked abrasive cloth 43 is then lifted above the stocker 84 and carried toward the rotary table 42. A backing paper remover 86, a constituent of the abrasive cloth replacing unit, is disposed adjacent to the stocker 84. The backing paper remover 86 is directed to peel the backing paper 85 from the abrasive cloth 43 carried out of the stocker 84. In this embodiment, the abrasive cloth applier 14, the abrasive cloth carrier 16 and the backing paper remover 86 constitute an abrasive cloth replacing unit.

Figure 10:
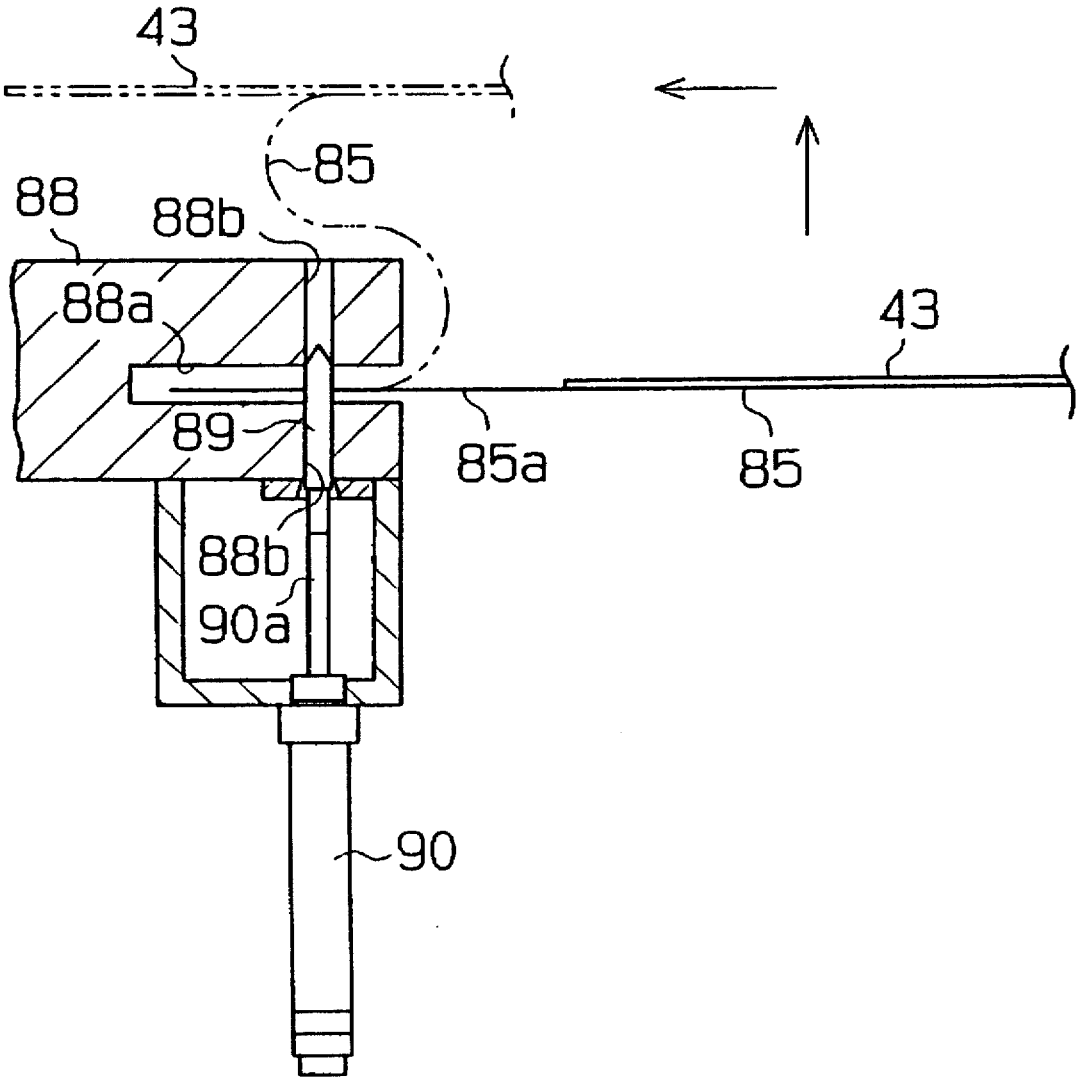
FIG. 10 is a partial cross-sectional view of a backing paper remover.

A pivotal arm 87 of the backing paper remover 86 shown in FIG. 4 turns from a stand-by position to an operational position simultaneously when the abrasive cloth 43 is carried out of the stocker 84 toward the rotary table 42. As shown in FIG. 10, a chucking block 88 for nipping the tongue 85*a* of the backing paper 85 is provided at the free end portion of the pivotal arm 87. A slit 88*a* is defined in the chucking block 88. When the pivotal arm 87 is locating at the operational position, the tongue 85*a* of the backing paper 85 applied to the abrasive cloth 43 being carried toward the rotary table 42 is inserted to the slit 88*a*.

The chucking block 88 has a through hole 88*b* intersecting with the slit 88*a*. A needle bar 89 is inserted to the through hole 88*b* upward to be reciprocatable in the vertical direction. An air cylinder 90 is secured on the lower surface of the chucking block 88. The rod 90*a* of the air cylinder 90 is connected to the needle bar 89. When the rod 90*a* is retracted to a stand-by position, the needle bar 89 is locating in the lower part of the through hole 88*b* below the slit 88*a*. On the contrary, when the rod 90*a* is protruding to an operational position, the needle bar 89 is advanced into the upper part of the through hole 88*b* above the slit 88*a*. When the air cylinder 90 is operated, the tongue 85*a* of the backing paper 85 is inserted to the slit 88*a*, and the rod 90*a* is simultaneously advanced to the operational position. Thus, the tongue 85*a* of the backing paper 85 is pierced by the needle bar 89.

With the tongue 85*a* being pierced by the needle bar 89, the suction plate 78 having the abrasive cloth 43 affixed thereto ascends above the chucking block 88. Subsequently, the suction plate 78 is turned toward the rotary table 42. Accordingly, the series of actions cause only the backing paper 85 to be pulled by the needle bar 89 piercing its tongue 85*a*. Thus, the abrasive cloth 43 is forwarded while the backing paper 85 is peeled from it as indicated by a dash and two-dotted line in FIG. 10. As soon as the backing paper 85 is fully peeled off, the needle bar 89 retracts into the lower part of the through hole 88*b*. Accordingly, the peeled backing paper 85 is disengaged from the needle bar 89 to drop into a disposal bin 91 locating on the downstream side of the remover 86, i.e. at a disposal site near the rotary table 42 (see FIG. 4).

The disposal bin 91 has a cylindrical form having an inner diameter greater than that of the stocker 84, and is located at a position above which the suction plate 78 passes. The disposal bin 91 receives backing papers 85 and used abrasive cloths 43.

Figure 11:
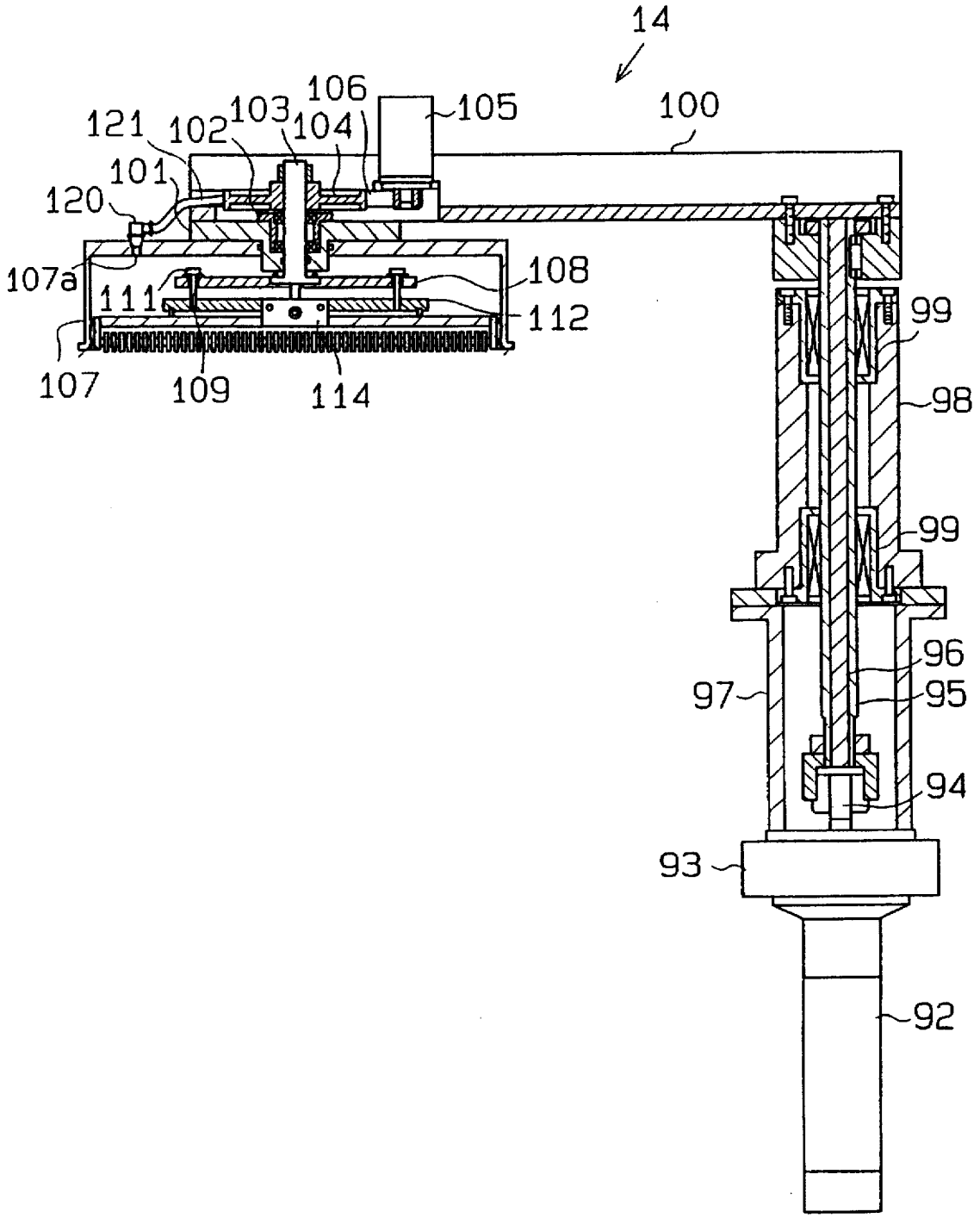
FIG. 11 is a vertical cross-sectional view of an abrasive cloth apparatus.

The abrasive cloth applier 14 is disposed on the left side wall 13 of the case 12. As shown in FIG. 11, a cylinder 92 is secured on the left side wall 13 and a rotary cylinder 93 disposed above the cylinder 92. The cylinder 92 and the rotary cylinder 93 constitute drive means. The rod 94 of the cylinder 92 is adapted to be reciprocated by the cylinder 92 in the vertical direction and to be rotated by the rotary cylinder 93. The rod 94 is connected to a pipe 95 and a rotary shaft 96 inserted to the pipe 95. The junction of the rod 94 with the pipe 95 and rotary shaft 96 is contained in a covering barrel 97 secured to the rotary cylinder 93. Further, the pipe 95 and rotary shaft 96 are supported by a pair of bearings 99 attached to a housing 98 fixed on the barrel 97 to be movable in the vertical direction and to be rotatable.

An arm 100 is fixed on the upper ends of the pipe 95 and rotary shaft 96. The arm 100 is ascended or descended in the vertical direction together with the pipe 95 and rotary shaft 96, and rotated on a horizontal plane. A circular supporting plate 101 is fixed on the lower surface of the arm 100 at its distal end portion. A rotary shaft 103 is rotatably supported by a bearing 102 on the supporting plate 101. A pulley 104 is fixed to the upper part of the rotary shaft 103. The pulley 104 is connected via a belt 106 to a motor 105 secured on the arm 100. Accordingly, the rotary shaft 103 is rotated under driving of the motor 105.

A cap 107 having a lower opening is secured on the lower surface of the supporting plate 101. The lower end portion of the rotary shaft 103 is protruding into the cap 107. A rotary plate 108 is secured on the lower end of the rotary shaft 103. The rotary plate 108 rotates together with the rotary shaft 103. The cap 107 has an inner diameter shorter than the diameter of the adhesion disc 39 and longer than the diameter of the abrasive cloth 43. The rotary shaft 103, pulley 104, motor 105 and rotary plate 108 constitute rotational drive means.

Figure 12:
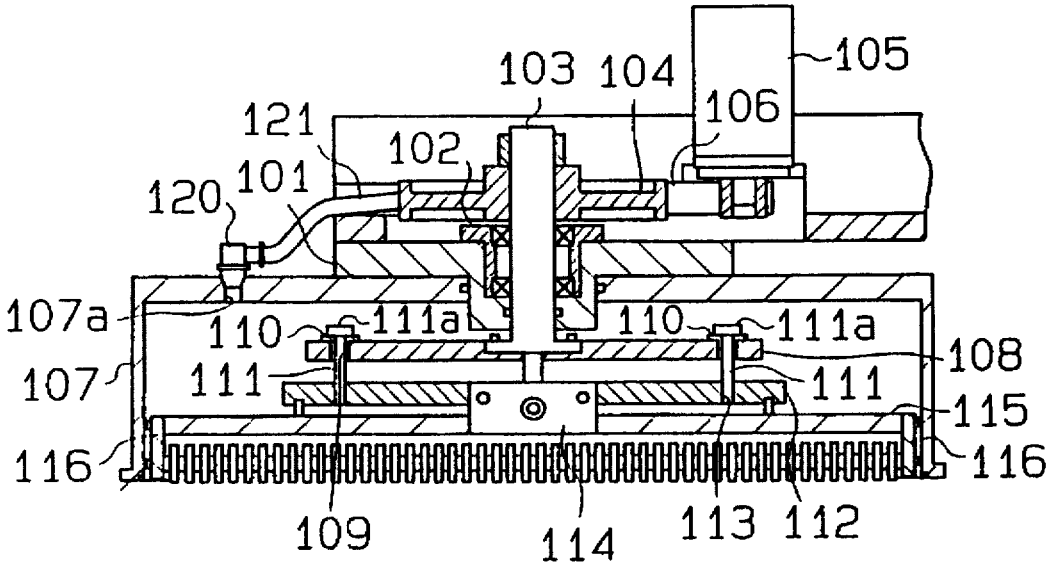
FIG. 12 is a an enlarged cross-sectional view of the abrasive cloth applier around its cap.

As shown in FIGS. 11 and 12, the rotary plate 108 has a plurality of through holes 109 defined at equiangular intervals. A flanged pipe 110 is inserted to each through hole 109 to be secured in it. A guide pin 111 is inserted to each pipe 110. The guide pin 111 is prevented from slipping off the pipe 110 by a stopper head 111a formed on the top of the pin 111. A circular connecting plate 112 contains a plurality of supporting holes 113 formed to be aligned with the through holes 109 of the rotary plate 108, respectively. The lower end portion of each guide pin 111 is secured in each supporting hole 113. Accordingly, the connecting plate 112 is suspended from the rotary plate 108 via the guide pins 111 to be movable in the vertical direction. Coil springs (not shown) are fitted around the guide pins 111 and sandwiched between the connecting plate 112 and the rotary plate 108. Each spring 76 has a resilience to push the connecting plate 112 downward.

Figure 13:
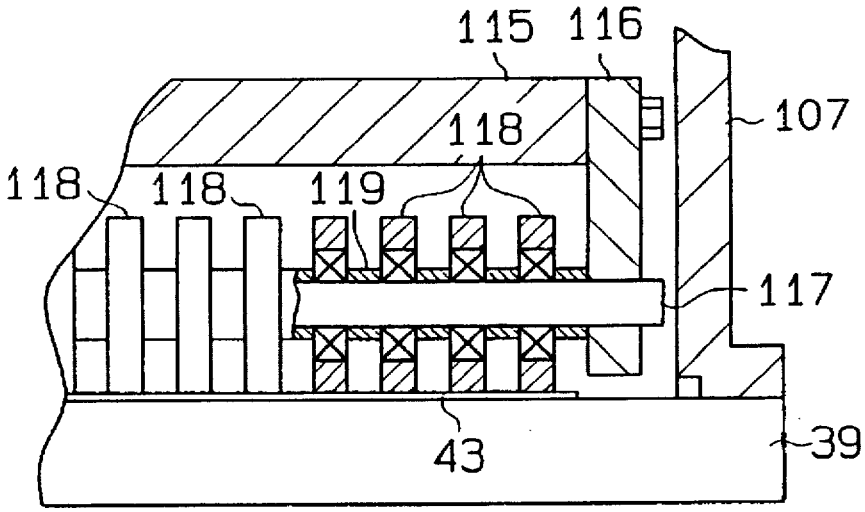
FIG. 13 is a partially enlarged cross-sectional view of the abrasive cloth applier.

A connecting block 114 is provided at the center of the connecting plate 112. A connecting bar 115 which is slightly longer than the diameter of the abrasive cloth 43 is connected to the lower surface of the connecting plate 112. As shown in FIG. 13, a pair of shaft supporting plates 116 are fixed to each end of the connecting bar 115. A shaft 117 is supported between the pair of shaft supporting plates 116. A plurality of pressure rollers 118 are rotatably supported on the shaft 117. Spacers 119 are interposed between the pressure rollers 118 respectively so as to secure equal intervals between the rollers 118.

A suction port 107*a* is defined through the top plate of the cap 107. A joint 120 is fitted in the suction port 107*a* and connected to a suction pump (not shown) via a suction pipe 121.

The arm 100 swings between the rotary table 42 and a position outside the casing 12, as shown in FIG. 4. The arm 100 turns toward the rotary table 42 and stops when the cap 107 is aligned with the rotary table 42.

Actions of the polishing apparatus according to this embodiment will now be described. During the rotation of the rotary table 42 having an abrasive cloth 43 applied thereon, the wafer 57 affixed to the rotating head 55 is descended until it is abutted against the rotating abrasive cloth 43. In this state, the head 55 is reciprocated radially with respect to the rotary table 42 to carry out planarization polishing of the wafer 57. During this polishing operation, an abrasive liquid is supplied onto the abrasive cloth 43. The film formed on the surface of the wafer 57 is gradually etched by this abrasive liquid. Thus, the reaction product formed on the wafer surface by etching reaction is ground by abrasive cloth 43 and the abrasive grains collected on the surface of cloth 43, and the wafer surface is thus gradually planarized.

In this polishing procedures, warm water (e.g., about 50° C.) is supplied to the introduction passage 40 of the adhesion disc 39 of the rotary table 42 to heat the adhesion disc 39, the abrasive cloth 43 and the abrasive liquid. The etching reaction is accelerated by heating the abrasive liquid to facilitate formation of the reaction product, thereby leading to reduction in the total polishing time.

Next, actions of the abrasive cloth applier 14 and the abrasive cloth carrier 16 provided in the polishing apparatus will be described. When the abrasive cloth 43 adhered onto the rotary table 42 is to be replaced with another, the head 55 is first retracted upward. Subsequently, a hot water (e.g., 80° to 100° C.) is supplied to the introduction passage 40 of the adhesion disc 39. This hot water heats the adhesion disc 39 to deactivate the adhesive adhering to the abrasive cloth 43 to the adhesion disc 39. Then, the arm 68 of the carrier 16 is turned toward the rotary table 42 until the suction plate 78 is aligned with the rotary table 42.

The arm 68 is descended until the suction plate 78 is abutted against the abrasive cloth 43. When the suction plate 78 is abutted against the abrasive cloth 43, suction force is applied to the suction plate 78 via the suction pipe 82. Then, the abrasive cloth 43 having reduced adhesion to the adhesion disc 39 is sucked onto the suction plate 78. After the abrasive cloth 43 is fully sucked onto the plate 78, the arm 68 ascends and carries the abrasive cloth 43 above the disposal bin 91. When the abrasive cloth 43 is above the disposal bin 91, the suction force exerted to the suction plate 78 is interrupted to allow the abrasive cloth 43 to drop into the disposal bin 91.

Subsequently, the arm 68 is turned toward the stocker 84 until the suction plate 78 is aligned with the stocker 84. The arm 68 then descends until the suction plate 78 is abutted against a new abrasive cloth 43 contained in the stocker 84. When the suction plate 78 is abutted against the new abrasive cloth 43, suction force is exerted through the suction pipe 82 to suck the abrasive cloth 43 onto the suction plate 78.

Once the abrasive cloth 43 has been sucked onto the suction plate 78, the arm 68 lifts the cloth 43 above the stocker 84 and carries the cloth 43 to the backing paper remover 86. The backing paper remover 86 allows the pivotal arm 87 to turn from the stand-by position to the operational position as the new abrasive cloth 43 is transported. In this process, the tongue 85*a* of the backing paper 85 applied to the abrasive cloth 43 is inserted to the slit 88*a* of the chucking block 88 and is pierced by the needle bar 89. The arm 68 ascends in this state to an upper position to avoid interference with the backing paper remover 86 and then turns toward the rotary table 42. With this turning of the arm 68, the backing paper 85 is peeled from the abrasive cloth 43 using the needle bar 89. After the backing paper 85 is fully peeled off, the needle bar 89 retracts into the lower portion of the through hole 88*b*. Then, the backing paper 85 is disengaged from the needle bar 89 and drops into the disposal bin 91.

The abrasive cloth 43 from which the backing paper 85 has been removed is transported toward the rotary table 42 until the suction plate 78 is aligned with the rotary table 42. The arm 68 then descends until the abrasive cloth 43 sucked onto the suction plate 78 is abutted against the adhesion disc 39. When the abrasive cloth 43 is abutted against the adhesion disc 39, the suction force exerted to the suction plate 78 is interrupted. Then, the abrasive cloth 43 is released from the suction plate 78 to be placed on the adhesion disc 39.

After the abrasive cloth 43 is released from the suction plate 78, the arm 68 returns to the stand-by position at the outside of the casing 12 to wait for another transportation action. When the arm 68 is assuming the stand-by posture, feeding of hot water to the introduction passage 40 of the adhesion disc 39 is interrupted, and a cool water (e.g., about 25° C.) is supplied instead to cool the adhesion disc 39.

After the arm 68 of the carrier 16 is turned to the outside of the casing 12, the arm 100 of the abrasive cloth applier 14 is turned toward the rotary table 42. The arm 100 is then stopped when the cap 107 is aligned with the rotary table 42. Next, the arm 100 descends until the cap 107 is abutted against the periphery of the adhesion disc 39 carrying the new abrasive cloth 43. As soon as the cap 107 is abutted against the adhesion disc 39, the pressure rollers 118 supported on the shaft 117 are abutted against the abrasive cloth 43. Simultaneously, the air within the cap 107 is sucked through the suction pipe 121. Meanwhile, the air between the adhesion disc 39 and the abrasive cloth 43 is sucked through the first passage 23 defined in the rotary shaft 20. Accordingly, the space surrounded by the adhesion disc 39 and the cap 107 assumes a vacuum state.

With this condition, when the motor 105 is driven to rotate the rotary shaft 103, the connecting bar 115 is rotated. Then, the pressure rollers 118 roll on the abrasive cloth 43 pressing the cloth 43. The abrasive cloth 43 is thus adhered onto the adhesion disc 39 by the pressure of the pressure rollers 118. During this adhesion procedure, since the space surrounded by the adhesion disc 39 and the cap 107 assumes a vacuum state, no air intrudes between the adhesion surface of the adhesion disc 39 and that of the abrasive cloth 43.

After the abrasive cloth 43 is completely adhered to the adhesion disc 39, the arm 68 ascends causing the cap 107 to be spaced apart from the adhesion disk 39 and atmospheric pressure is resumed in the space surrounded between the adhesion disc 39 and the cap 107. The arm 100 then returns to the stand-by position at the outside of the casing 12 to wait for a next application action.

As described above, the abrasive cloth carrier 16 provided in the polishing apparatus 11 enables automatic removal of a to-be-replaced abrasive cloth 43 from the rotary table 42 requiring no manual procedures of an operator. Besides, since the used abrasive cloth 43 is automatically received in the disposal bin 91 provided at the outside of the casing 12, the operator need not touch the abrasive cloth 43 during the operation of removing the cloth 43. Hence, no pollution of the working environment is caused by the abrasive grains and the like adhered to the cloth 43.

According to the present invention, a new abrasive cloth 43 contained in the stocker 84 can be loaded automatically on the rotary table 42 by the carrier 16 requiring no manual procedures of an operator. Besides, the backing paper 85 applied to the abrasive cloth 43 can be peeled off automatically, i.e., requiring no manual procedures of the operator, by the backing paper remover 86 provided on the route of transporting the new abrasive cloth 43.

Further, since the backing paper 85 is guided by the abrasive cloth 43 toward the disposal bin 91 as it is peeled, the backing paper 85 can be securely dropped into the disposal bin 91. Accordingly, disposal of the backing papers 85 is also facilitated by the present invention. Additionally, the tongue 85*a* formed on the backing paper 85 enables the backing paper remover 86 to remove only the backing paper 85.

The abrasive cloth applier 14 provided in the polishing apparatus 11 makes it possible to adhere a new abrasive cloth 43 automatically onto the rotary table 42 without requiring manual procedures of an operator. In such processing, the plurality of pressure rollers 118 press the abrasive cloth 43 to adhere the cloth 43 uniformly onto the adhesion disc 39. Further, a vacuum state is created around the abrasive cloth 43 during the adhesion operation so as to prevent air cells from being included in the adhesion surface between the adhesion disc 39 and the abrasive cloth 43.

The polishing apparatus 11 according to the present invention enables full automation of the procedures for replacing the abrasive cloth 43. Consequently, not only the labor required for the replacement procedures but also pollution caused by the replacement procedures can be reduced.

Although only one embodiment of the present invention has been described herein, it should be apparent to those skilled in the art that the present invention may be embodied in many other specific forms without departing from the spirit or scope of the invention. Particularly, it should be understood that the present invention may be embodied in the following manners.

The present invention may be applied to an abrasive cloth coated with an adhesive which loses adhesiveness by UV light irradiation. In this case, a UV irradiator 130 should be disposed adjacent to the rotary table 42, as indicated by a dash and two-dotted line in FIG. 4. Adhesion between the adhesion disc 39 and the abrasive cloth 43 is weakened by the UV light irradiated from the irradiator 130. Such adhesive which loses adhesiveness by UV light irradiation includes, UV-curing adhesive mass (commercially available from Nitto Denko Kabushiki-Kaisha).

The present invention may be applied to an abrasive cloth coated with an adhesive whose adhesiveness is weakened at a low temperature.

The present invention may be embodied using an abrasive cloth 43 having no adhesive coating. In this case, the polishing treatment is carried out by exerting a suction force to the adhesion disc 39 through the first passage 23 defined in the rotary shaft 20 of the surface plate 19 to suck the cloth 43 onto the adhesion disc 39. The abrasive cloth 43 can be peeled from the adhesion disc 39 by interrupting the suction force. This not only facilitates the procedures of replacing the abrasive cloth 43 but also makes the backing paper 85 and abrasive cloth applier 14 unnecessary.

Either the abrasive carrier 16 or the abrasive applier 14 may be provided in the polishing apparatus.

The polishing apparatus according to the present invention may be employed for polishing plate materials made of polysilicones or metals such as tungsten, aluminum and copper.

Therefore, the present example and embodiment are to be considered as illustrative and not restrictive, and the invention is not to be limited to the details given herein, but may be modified within the scope of the appended claims.

What is claimed is:

1. An apparatus for polishing a material to be treated by moving an abrasive cloth and said material relative to each other while said material is pressed against said abrasive cloth, said apparatus comprising:

a table on which said abrasive cloth is removably applied; and an abrasive cloth replacing means for automatically replacing a worn abrasive cloth on said table with a new, unused abrasive cloth, wherein said abrasive cloth replacing means comprises an abrasive cloth carrier means for picking up said worn abrasive cloth on said table and carrying said worn abrasive cloth to a disposal site.

2. The polishing apparatus according to claim 1, wherein said abrasive cloth replacing means further comprises:

a cloth storage means for storing therein a plurality of said new, unused abrasive cloths; and said abrasive cloth carrier means also for picking up a new, unused abrasive cloth from said cloth storage means and carrying said new, unused abrasive cloth to said table.

3. The polishing apparatus according to claim 1, wherein said abrasive cloth replacing means further comprises:

a cloth storage means for storing therein a plurality of said new, unused abrasive cloths: and said abrasive cloth carrier means also for picking up said worn abrasive cloth on said table to carry said worn abrasive cloth to said disposal site and then picking up said new, unused abrasive cloth from said cloth storage means and carrying said new, unused abrasive cloth to said table.

4. The polishing apparatus according to claim 3, wherein said abrasive cloth carrier means further comprises:

an arm having a distal end and a proximal end, said arm being movable in a vertical direction and pivotable in a horizontal direction on said proximal end;

drive means for vertically moving said arm and for pivoting said arm in said horizontal direction; and a suction plate, attached to said distal end of said arm, for holding said new, unused abrasive cloth thereon using suction.

5. The polishing apparatus according to claim 1, wherein said abrasive cloth has an adhesive surface to which a backing paper is applied, and wherein said abrasive cloth replacing means further comprises:

a cloth storage means for storing therein a plurality of said new, unused abrasive cloths;

said abrasive cloth carrier means also for picking up said new, unused abrasive cloth from said cloth storage means and transporting said new, unused abrasive cloth to said table; and a backing release means for peeling a backing paper from said new, unused abrasive cloth in cooperation with said abrasive cloth carrier means upon transporting said new, unused abrasive cloth toward said table.

6. The polishing apparatus according to claim 1, wherein said abrasive cloth has an adhesive surface to which a backing paper is applied, and wherein said abrasive cloth replacing means further comprises:

a cloth storage means for storing therein a plurality of said new, unused abrasive cloths;

said abrasive cloth carrier means also for picking up said worn abrasive cloth on said table and carrying said worn abrasive cloth to said disposal site and then picking up at least one of said new, unused abrasive cloths from said cloth storage means and carrying said new, unused abrasive cloth to said table; and a backing release means for peeling said backing paper from said new, unused abrasive cloth in cooperation with said abrasive cloth carrier means upon transporting said new, unused abrasive cloth toward said table.

7. The polishing apparatus according to claim 1, wherein said abrasive cloth replacing means further comprises:

a cloth storage means for storing therein a plurality of said new, unused abrasive cloths; and an abrasive cloth applier means for pressing said new, unused abrasive cloth against said table.

8. The polishing apparatus according to claim 7, wherein said abrasive cloth applier means further comprises:

an arm having a distal end and a proximal end, said arm being movable in a vertical direction and pivotable in a horizontal direction on said proximal end;

first drive means for vertically moving said arm;

second drive means for pivoting said arm in said horizontal direction;

a rotary plate rotatably provided at said distal end of said arm;

third drive means for causing said rotary plate to be rotated; and means, attached to said rotary plate, for pressing said new, unused abrasive cloth against said table.

9. The polishing apparatus according to claim 8, wherein said abrasive cloth applier means further comprises:

a cap covering said rotary plate and said pressing means thereby forming a cavity; and suction means, coupled to said cap, for sucking air from said cavity.

10. A unit for transporting abrasive cloths, comprising:

an arm having a distal end and a proximal end;

a shaft connected to said proximal end of said arm and extending in a direction perpendicular to said arm, said arm being movable together with said shaft around said shaft;

an air cylinder means for moving said arm together with said shaft in said vertical direction, said air cylinder means including a rod connected to said shaft;

a rotary cylinder means for rotating said arm together with said shaft around said shaft via said rod, said air cylinder means and said rotary cylinder means being located on a line extending from an axis of said shaft; and a suction plate attached to said distal end of said arm, for holding an abrasive cloth thereon using suction.

11. A unit for applying an abrasive cloth to a table, comprising:

an arm having a distal end and a proximal end, said arm being movable in a vertical direction and pivotable in a horizontal direction on the proximal end;

first drive means for vertically moving said arm;

second drive means for pivoting said arm in the horizontal direction;

a rotary plate rotatably provided at the distal end of said arm;

third drive means for causing said rotary plate to be rotated; and pressing means, attached to said rotary plate, for pressing an abrasive cloth against said table.

12. The unit according to claim 11, wherein said pressing means includes a plurality of rollers.

13. An apparatus for polishing a material to be treated by moving an abrasive cloth and said material relative to each other while said material is pressed against the abrasive cloth, said apparatus comprising:

a table on which said abrasive cloth is removably applied; and an abrasive cloth replacing unit including a abrasive cloth carrier and a abrasive cloth applier, said abrasive cloth carrier being adapted to pick up a new abrasive cloth from a cloth storage device, in which at least one unused abrasive cloth is stored, and to carry the new abrasive cloth to said table, said abrasive cloth applier being adapted to press said new abrasive cloth against said table.

14. An apparatus for polishing a material to be treated by moving an abrasive cloth and said material relative to each other while said material is pressed against the abrasive cloth, said apparatus comprising:

a table on which said abrasive cloth is removably applied;

an abrasive cloth replacing unit for automatically replacing the abrasive cloth on said table with a new abrasive cloth; and an abrasive cloth applier for pressing an abrasive cloth against said table.

15. The polishing apparatus according to claim 14, wherein the material being polished is a semiconductor wafer.

16. The polishing apparatus according to claim 14, wherein said abrasive cloth has an adhesive surface to which a backing paper is applied, wherein said abrasive cloth replacing unit includes:

a cloth storage device for storing therein a plurality of unused abrasive cloths;

an abrasive cloth carrier for picking up a new abrasive cloth from said cloth storage device and transporting the new abrasive cloth to said table; and a backing release unit for peeling the backing paper from the new abrasive cloth in cooperation with said abrasive cloth carrier upon transporting the new abrasive cloth toward said table.

17. The polishing apparatus according to claim 16, wherein said abrasive cloth applier comprises:

an arm having a distal end and a proximal end, said arm being movable in a vertical direction and pivotable in a horizontal direction on the proximal end;

first drive means for vertically moving said arm;

second drive means for pivoting said arm in the horizontal direction;

a rotary plate rotatably provided at the distal end of said arm;

third drive means for causing said rotary plate to be rotated; and means, attached to said rotary plate, for pressing an abrasive cloth against the table.

18. The polishing apparatus according to claim 17, wherein said abrasive cloth applier further comprises:

a cap covering said rotary plate and said pressing means thereby forming a cavity; and suction means coupled to said cap, for sucking air from the cavity.

19. The polishing apparatus according to claim 16, wherein said abrasive cloth carrier comprises:

an arm having a distal end and a proximal end, said arm being movable in a vertical direction and pivotable in a horizontal direction on the proximal end;

first drive means for vertically moving said arm;

second drive means for pivoting said arm in the horizontal direction; and a suction plate attached to the distal end of said arm, for holding an abrasive cloth thereon using suction.

* * * * *